US006314258B1

(12) United States Patent
Ishii et al.

(10) Patent No.: US 6,314,258 B1
(45) Date of Patent: Nov. 6, 2001

(54) IMAGE FORMING APPARATUS REALIZING STABLE CHARGING AND DEVELOPMENT CHARACTERISTICS

(75) Inventors: Hiroshi Ishii, Osaka; Atsushi Inoue, Nara, both of (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/610,475

(22) Filed: Jul. 5, 2000

(30) Foreign Application Priority Data

Jul. 21, 1999 (JP) ..... 11-206050

(51) Int. Cl.[7] ..... G03G 5/14; G03G 15/00

(52) U.S. Cl. ..... 399/159; 399/176; 399/222; 430/60; 430/902

(58) Field of Search ..... 399/159, 161, 399/168, 174, 176, 222; 430/60, 120, 902

(56) References Cited

U.S. PATENT DOCUMENTS 5,610,721 3/1997 Higuchi et al. ..... 358/396
5,708,932 * 1/1998 Yano et al. ..... 399/159
5,729,800 * 3/1998 Ohba et al. ..... 399/159
6,097,918 8/2000 Inoue et al. ..... 399/265

FOREIGN PATENT DOCUMENTS

A5216263 8/1993 (JP) .

* cited by examiner

*Primary Examiner*—Sophia S. Chen

(57) ABSTRACT

To provide an image forming apparatus which can realize stable charging and development characteristics, with a high resistance provided on the photoreceptor side.

A photoreceptor drum is laminated with a high-resistance layer, and with a photoreceptor layer. A charging roller is provided with a metal shaft on a photoreceptor support and it is laminated with a low-resistance layer. In the image forming apparatus, a condition, $T/(Rp \times \epsilon p/dp) > 2.3$, is satisfied, where Rp ($\Omega m^2$) is the resistance per unit area of the resistance layer in the perpendicular direction, T (sec) is a passage time of the charging nip at each point on a surface of the photoreceptor drum, $\epsilon p$ (F/m) is a dielectric constant of the photoreceptor layer, and dp (m) is a film thickness of the photoreceptor layer.

22 Claims, 6 Drawing Sheets

IMAGE FORMING APPARATUS REALIZING STABLE CHARGING AND DEVELOPMENT CHARACTERISTICS

BACKGROUND OF THE INVENTION

1. Field of the Invention

The present invention relates to an image forming apparatus using a photoreceptor, and particularly to an image forming apparatus in which the photoreceptor is provided with a resistor, when executing a contact discharging and development of the photoreceptor.

2. Description of the Related Art

An image forming apparatus which forms an image by using a photoreceptor, such as copiers, first it charges the whole surface of the photoreceptor (primary charging) which is a previous step to form an electrostatic latent image on the charged surface of the photoreceptor (latent image formation). Secondly, the electrostatic latent image is developed so as to visualize the formed latent image (development). For the primary charging, a charging roller is frequently used for contact charging, instead of corona discharging to prevent from being produced ozone. In addition, a development roller is frequently used for development, where the development roller is in contact with the photoreceptor so as to supply charged toner. The charge is transferred from one-component or two-component developer to the photoreceptor.

For example, when the surface of the photoreceptor is negatively charged, and attempts executing a homopolar development, the voltages required for the drive of the charging and development come to minus several hundreds of volts. Therefore, each roller is provided with a resistor which is made of a material having a certain measure of resistance, such as rubber, for the purpose of avoiding short-circuit currents from flowing through when the above high voltages are applied from the respective metal shafts of the charging and development rollers. Accordingly, various analysis of the charging and development characteristics has been conducted by providing the resistor.

For example, Japanese Examined Patent Publication, No. 7-92617 discloses a charging model based on capacitance of a photoreceptor and resistance of a charging member. Japanese Unexamined Patent Publication, No. 3-87759 discloses a method of analyzing development characteristics by iterated calculations based on an electric field model. Japanese Unexamined Patent Publication, No. 1-230079 discloses a method of analyzing development characteristics of an insulated type development roller based on a capacitor model. Japanese Unexamined Patent Publication, No. 5-216263 discloses a technique for preventing a breakdown by an intermediate layer of a photoreceptor.

As mentioned above, the conventional charging roller is made of a high-resistance conductive elastic rubber, and is used for preventing the breakdown due to a pinhole in the photoreceptor. However, there have been problems in such rubber that it is difficult to suppress the variation of the resistances in each roller and the variation between the rollers. In addition, the resistance is greatly susceptible to the environment, in particular, humidity. Actually, the distribution of the resistance shows great range, e.g., about one-half to one order with respect to the resistance, in taking account of the variation in the resistance. Therefore, it is apt to need a roller of high performance and high accuracy, and therefore the cost would be increased.

Another image forming apparatus, a high-resistance layer is provided in the photoreceptor in order to prevent the breakdown in the photoreceptor, where the layer is treated with aluminum. However, in this case, an overcurrent due to a pinhole flows even if the breakdown does not occur, and thus causes the charging voltage drops due to activation of a power supply limiter. Nevertheless, no countermeasure is provided against the voltage drop. Therefore, this will lead to instability of charging voltage.

Further, the above problems are also found in the development rollers.

SUMMARY OF THE INVENTION

The present invention has been made to solve the aforementioned problems. An object of the present invention is to provide an image forming apparatus which can realize stable charging and development characteristics, with a high-resistance provided on the photoreceptor side.

According to one aspect of the present invention, there is provided an image forming apparatus comprising a photoreceptor drum which rotates when the photoreceptor drum is driven; and a charging roller which is arranged in contact with the photoreceptor drum so as to charge the surface of the charging roller. The photoreceptor drum is laminated with a resistance layer which is provided on a photoreceptor support, and with a photoreceptor layer on which an electrostatic latent image is formed by exposure. In the image forming apparatus, a condition, $T/(Rp\times\epsilon p/dp)>2.3$, is satisfied, where T (sec) is the passage time of the charging nip at each point on a surface of the photoreceptor drum, Rp ($\Omega m^2$) is the resistance per unit area of the resistance layer in the perpendicular direction, $\epsilon p$ (F/m) is the dielectric constant of the photoreceptor layer, and dp (m) is the film thickness of the photoreceptor layer.

The photoreceptor support is made of the conductive layer, and is used as the resistance layer. In addition, a resin of low absorbency is used as a photoreceptor support e.g., polycarbonate on which carbon black is being dispersed. Therefore, it eliminates the need for providing an additional resistance layer, thus simplifying their construction.

According to another aspect of the present invention, there is provided an image forming apparatus comprising a photoreceptor drum which rotates when the photoreceptor drum is driven; and a development roller which is arranged in contact with the photoreceptor drum so as to supply a toner to the photoreceptor drum. The photoreceptor drum is laminated with a resistance layer which is provided on a photoreceptor support, and with a photoreceptor layer on which an electrostatic latent image is formed by exposure. In the image forming apparatus, a condition, $Rp/(dt/\epsilon t+dp/\epsilon p)\leqq 1$, is satisfied, where Rp ($\Omega m^2$) is the resistance per unit area of the resistance layer in the perpendicular direction, dt (m) is the thickness of the toner layer before development, $\epsilon t$ (F/m) is the dielectric constant of the toner layer, dp (m) is the film thickness of the photoreceptor layer, and $\epsilon p$ (F/m) is the dielectric constant of the photoreceptor layer.

When the respective items of the inequality are defined as above for the development characteristics, in which the amounts of development varies depending on the resistance, the development is carried out under the region of an inflection point where the amounts of the development begins to drop from the predetermined value. This ensures high development efficiency, and therefore enables stable development.

Further, when a condition, $Rp/(dt/\epsilon t+dp/\epsilon p)\leqq 0.25$, is satisfied, it ensures high development efficiency higher than 80%. This promotes prevention of degradation or fixation of the toner, and lengthen the life span of the photoreceptor drum and the development roller.

According to yet another aspect of the present invention, there is provided an image forming apparatus comprising a photoreceptor drum which rotates when the photoreceptor drum is driven; and a development roller which is arranged in contact with the photoreceptor drum so as to supply a toner to the photoreceptor drum. The photoreceptor drum is laminated with a resistance layer which is provided on a photoreceptor support, and with a photoreceptor layer on which an electrostatic latent image is formed by exposure. In the image forming apparatus, a condition, $(Rr/k)/(dt/\epsilon t+dp/\epsilon p)\leqq 1$, is satisfied, where Rr ($\Omega m^2$) is the resistance per unit area of the development roller in the perpendicular direction, vr is a peripheral velocity of the development roller, vp is a peripheral velocity of the photoreceptor drum, k=vr/vp, dt (m) is the thickness of the toner layer before development, $\epsilon t$ (F/m) is the dielectric constant of the toner layer, dp (m) is the film thickness of the photoreceptor layer, and $\epsilon p$ (F/m) is the dielectric constant of the photoreceptor layer.

When the respective items of the inequality are defined as above for the development characteristics, in which the amounts of development varies depending on the resistance, the development is carried out under the region of an inflection point where the amounts of the development begins to drop from the predetermined value. This ensures high development efficiency and therefore enables stable development.

Further, when a condition, $(Rr/k)/(dt/\epsilon t+dp/\epsilon p)\leqq 0.25$, is satisfied, it ensures the high development efficiency higher than 80%. This promotes prevention of degradation or fixation of the toner, and lengthen the life span of the photoreceptor drum and the development roller.

According to still another aspect of the present invention, there is provided an image forming apparatus comprising a photoreceptor drum which rotates when the photoreceptor drum is driven; and a development roller which is arranged in contact with the photoreceptor drum so as to form a path of a development current, and to supply a toner to the photoreceptor drum. The photoreceptor drum is laminated with a resistance layer which is provided on a photoreceptor support, and with a photoreceptor layer on which an electrostatic latent image is formed by exposure. In the image forming apparatus, a condition, $(Rs\times vp\times W)/(dt/\epsilon t+dp/\epsilon p)\leqq 1$, is satisfied, where Rs ($\Omega$) is the resistance value of the current limit means provided in the path of the development current, vp is a peripheral velocity of the photoreceptor drum, W (m) is an effective development width, dt (m) is the thickness of the toner layer before development, $\epsilon t$ (F/m) is the dielectric constant of the toner layer, dp (m) is the film thickness of the photoreceptor layer, and $\epsilon p$ (F/m) is the dielectric constant of the photoreceptor layer.

When the respective items of the inequality are defined as above for the development characteristics, in which the amounts of development varies depending on the resistance, the development is carried out under the region of an inflection point where the amounts of development begins to drop from the predetermined value. This ensures high development efficiency, and therefore enables stable development.

Further, when a condition, $(Rs\times vp\times W)/(dt/\epsilon t+dp/\epsilon p)\leqq 0.25$, is satisfied, it ensures the high development efficiency higher than 80%. This promotes prevention of degradation or fixation of the toner, and lengthen the life span of the photoreceptor drum and the development roller.

According to yet still another aspect of the present invention, there is provided an image forming apparatus comprising a photoreceptor drum which rotates when the photoreceptor drum is driven; and a development roller which is arranged in contact with the photoreceptor drum so as to form a path of a development current, and to supply a toner to the photoreceptor drum. The photoreceptor drum is laminated with a resistance layer which is provided on a photoreceptor support, and with a photoreceptor layer on which an electrostatic latent image is formed by exposure. In the image forming apparatus, a condition, $(Rp+Rr/k+Rs\times vp\times W)/(dt/\epsilon t+dp/\epsilon p)\leqq 1$, is satisfied, where Rp ($\Omega m^2$) is the resistance per unit area of the resistance layer in the perpendicular direction, Rr ($\Omega m^2$) is the resistance per unit area of the development roller in the perpendicular direction, vr is a peripheral velocity of the development roller, vp is a peripheral velocity of the photoreceptor drum, k=vr/vp, Rs ($\Omega$) is the resistance value of the current limit means, W (m) is an effective development width, dt (m) is the thickness of the toner layer before development, $\epsilon t$ (F/m) is the dielectric constant of the toner layer, dp (m) is the film thickness of the photoreceptor layer, and $\epsilon p$ (F/m) is the dielectric constant of the photoreceptor layer.

When the items of the inequality are defined as above for the development characteristics, in which the amounts of development varies depending on the resistance, the development is carried out under the region of an inflection point where the amounts of development begins to drop from the predetermined value. This ensures the high development efficiency, and therefore enables stable development.

Further, when a condition, $(Rp+Rr/k+Rs\times vp\times W)/(dt/\epsilon t+dp/\epsilon p)\leqq 0.25$, is satisfied, it ensures the high development efficiency higher than 80%. This promotes prevention of degradation or fixation of the toner, and lengthen the life span of the photoreceptor drum and the development roller.

The photoreceptor support is made of the conductive layer, and is used as the resistance layer. In addition, a resin of low absorbency is used as a photoreceptor support, e.g., polycarbonate in which carbon black is being dispersed. Therefore, it eliminates the need for providing an additional resistance layer, thus simplifying their construction.

DESCRIPTION OF THE PREFERRED EMBODIMENTS

Preferred embodiments of the present invention will be explained in detail below, with reference to the drawings.

Figure 1:
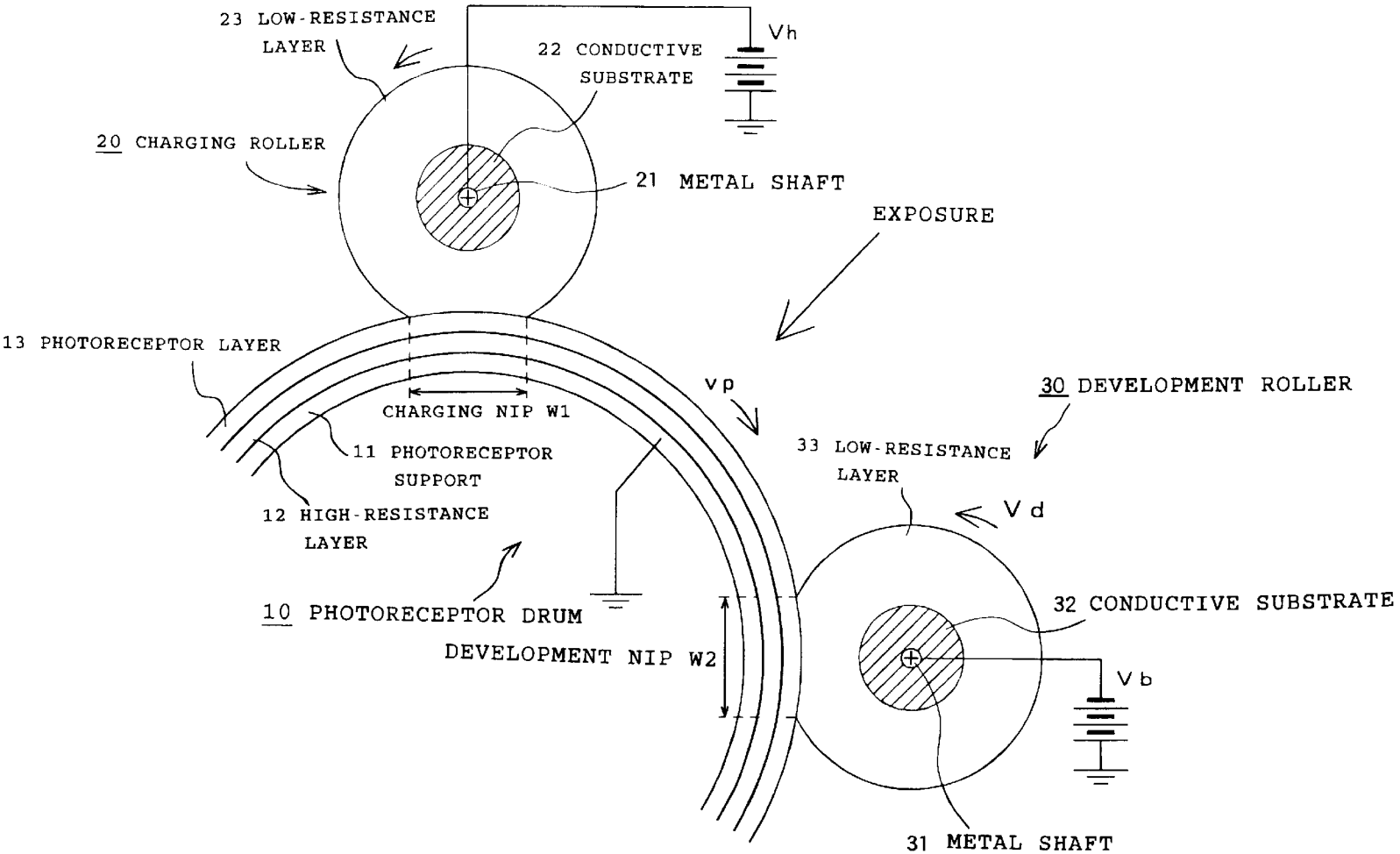
FIG. 1 is a diagram illustrating the essential part of the image forming apparatus of one embodiment of the present invention.

FIG. 1 is a circuit diagram illustrating the main part of the image forming apparatus of one embodiment of the present invention. In FIG. 1, a photoreceptor drum 10 includes a cylindrical photoreceptor support 11, laminated with a high-resistance layer 12 and including a photoreceptor layer 13 thereon. The photoreceptor support 11 is made of Aluminum. A charging roller 20 includes a cylindrical metal shaft 21, and a conductive substrate 22 provided around the metal shaft 21. A low-resistance layer 23 is laminated on the conductive substrate 22. Further, a development roller 30 includes a cylindrical metal shaft 31, and a conductive substrate 32 provided around the shaft 31. A low-resistence layer 33 is laminated on the conductive substrate 32.

The photoreceptor support 11 of the photoreceptor drum 10 is grounded, a high negative direct current voltage Vh is applied to the metal shaft 21 of the charging roller 20. Another high negative direct current voltage Vb is applied to the metal shaft 31 of the development roller 30. The surface of the charging roller 20 is in contact with that of the photoreceptor drum 10 at the charging nip W1, which is the contact area between the photoreceptor drum 10 and the charging roller 20. When the photoreceptor drum 10 is driven, the charging roller 20 is rotated accompanying with the rotation of the photoreceptor drum 10. In addition, the surface of the development roller 30 is also in contact with that of the photoreceptor drum 10 at the development nip W2, which is the contact area between the photoreceptor drum 10 and the development roller 30. When the photoreceptor drum 10 is driven at a peripheral velocity vp, the development roller 30 is driven at that of a velocity vd.

Figure 2:
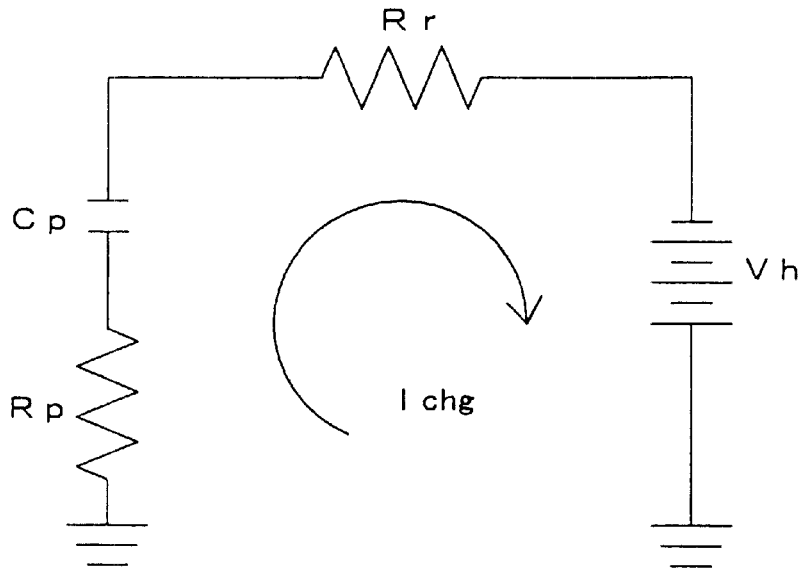
FIG. 2 is a circuit diagram illustrating an equivalent circuit of the current path through which the charging current $I_{chg}$ flows.
Figure 3:
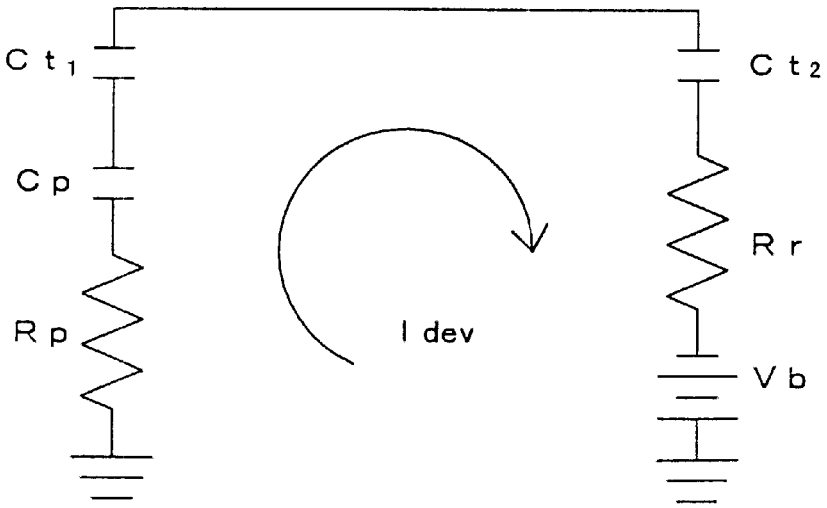
FIG. 3 is a circuit diagram illustrating an equivalent circuit of the current path through which the developing current $I_{dev}$ flows.

In the image forming apparatus having the construction as above, equivalent circuits of the path through which the charging current $I_{chg}$ and development current $I_{dev}$ flow are shown in FIGS. 2 and 3, respectively. The path of the charging current $I_{chg}$ is represented by a series circuit, including the resistance Rp of the high-resistance layer 12 of the photoreceptor drum 10, the capacitance Cp of the photoreceptor layer 13, the resistance Rr of the low-resistance layer 23 of the charging roller 20, and a power supply of the high negative direct current voltage Vh.

Similarly, the path of the developing current $I_{dev}$ is represented by a series circuit including the resistance Rp of the high-resistance layer 12 of the photoreceptor drum 10, the capacitance Cp of the photoreceptor layer 13, the capacitors Ct1 and Ct2, the resistance Rr of the low-resistance layer 33 of the development roller 30, and a power supply of the development bias voltage Vb, where the capacitors Ct1 and Ct2 represent the capacitance of a toner layer.

As illustrated in FIG. 1, the high-resistance layer 12 is laminated on only the photoreceptor drum 10, while, conventionally, high-resistance layers are laminated both on the charging roller and development roller. That is, only the low-resistance layer is laminated on each of the charging roller and the development roller. Therefore, it facilitates manufacturing of the charging roller and development roller, and reduces the range of variations of the resistance of the charging roller and the development roller due to differences in each lot and environmental factors even if they may occur so that any affection on the charging and development characteristics will not be observed. In addition, the photoreceptor drum 10 is laminated with the high-resistance layer 12. Therefore, the possibility of moisture absorption is low, and the range of variations in the photoreceptor drum 10 can also be reduced. Further, the construction of the photoreceptor support 11 by a conductive resin having low moisture absorbency, e.g., polycarbonate in which carbon black is being dispersed, and the use thereof as the high-resistance layer 12, eliminates the need for providing an additional high-resistance layer, thus simplifying the construction of the photoreceptor drum 10. Alternatively, the high-resistance layer 12 may be used as a charge injection stop layer, which is usually provided on the photoreceptor drum 10, thus also simplifying the construction of the photoreceptor drum 10.

Setting various parameters as above, it becomes possible to stabilize the charging and development characteristics.

Figure 4:
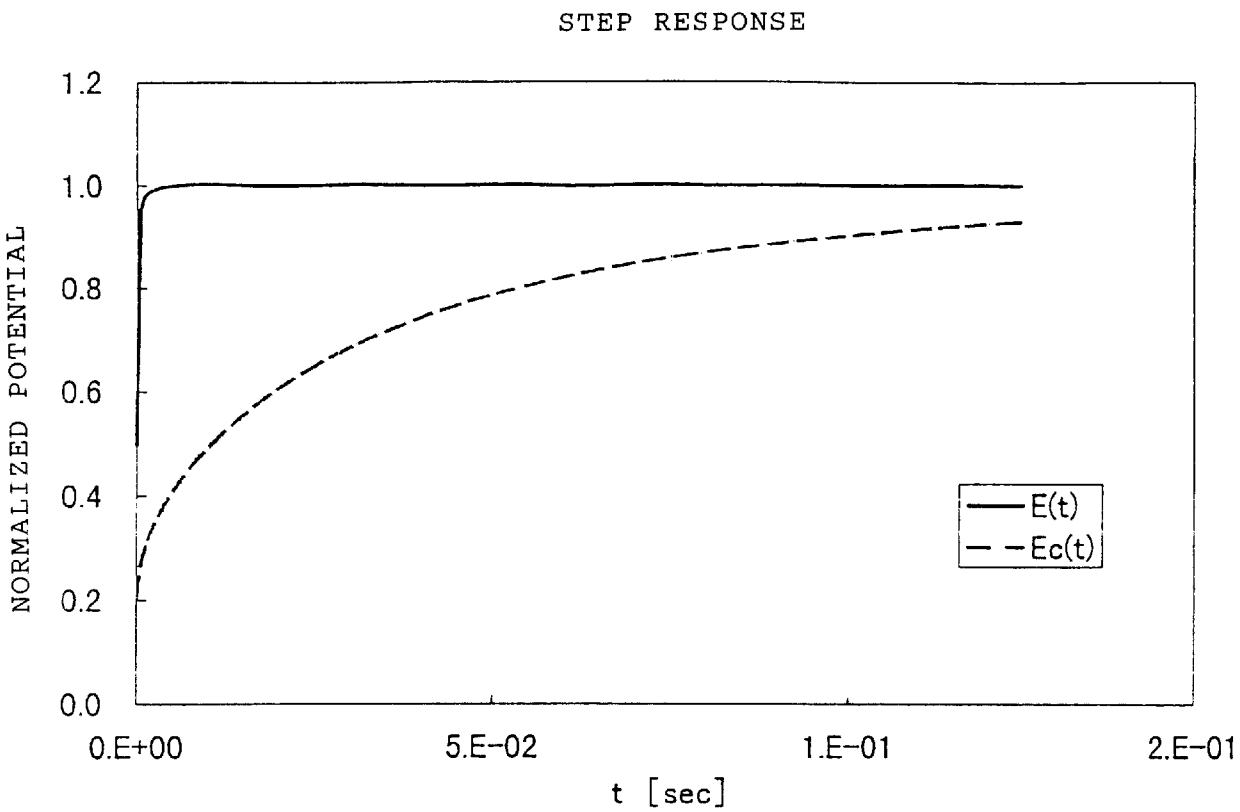
FIG. 4 is a graph indicating a step response based on the charging model.

An example of the results of the simulation is shown in FIG.4. The results are obtained by simulating a step response of the surface potential of the photoreceptor drum 10 with respect to an application of the high negative direct current voltage Vh, based on the charging model in FIG. 2. In FIG. 4, E(t) is a normalized voltage applied to the charging roller 20, and Ec(t) is a normalized surface potential of the photoreceptor drum 10. In this case, letting the dielectric constant of the photoreceptor layer 13 to be $\epsilon p$ (F/m), the film thickness of the photoreceptor layer 13 to be dp (m), the resistance per unit area of the high-resistance layer 12 in the perpendicular direction to be Rp ($\Omega m^2$), and the passage time of the charging nip w1 at each point on the surface of the photoreceptor drum 10 to be T (sec), the resistance Rr of the low-resistance layer 23 in the charging roller 20 can be ignored. Consequently, charging time constant $\tau$ the photoreceptor layer 13 is given as follows, $$\tau = Rp \times Cp = Rp \times \epsilon p/dp,\ T/(Rp \times \epsilon p/dp) > 2.3, \quad (1)$$

From the inequality, it is shown that the variation $\Delta V$ in the surface potential of the photoreceptor drum 10 becomes less than 10%, and therefore an advantageous charging characteristics is obtained.

Next, an approximate equation is shown below, based on the model of the development current circuit in FIG. 3. The equation derives the developed amount Mp by adding an equilibrium of the electric field, with a transfer of charge and voltage drop due to the developing current added. However, the resistance Rp of the high-resistance layer 12 is ignored, and instead introduces an assumption that a high-resistance layer is arranged in the development roller 30.

After finding the equilibrium point of electric fields, the thickness x (m) of the toner layer is given by the following equality.

$$x = c/b,$$

$$b = \rho \times (dt/\epsilon t + dp/\epsilon p + Rr/k), \text{ and}$$

$$c = (-Vo + Vb + Vt \times k),$$

where $\rho$ ($C/m^3$) is the charge density of the toner layer, dt (m) is the thickness of the toner layer before development, $\epsilon t$(F/m) is the dielectric constant of the toner layer, Rr ($\Omega m^2$) is the resistance value of the low-resistance layer 33 of the development roller 30, Vo (V) is a bias voltage of the surface potential of the photoreceptor drum 10, Vb (V) is the development roller 30, Vt (V) is the potential of the toner layer on the development roller 30 before development, and k=vr/vp is the ratio of peripheral velocity of the development roller 30 and the photoreceptor drum 10.

Letting the deposit amount of the toner on the development roller 30 before development to be m ($kg/m^2$), the developed amount Mp ($kg/m^2$) on the photoreceptor drum 10 after development is given by the following equality $$Mp = (m/dt) \times x. \quad (2)$$

For reference purpose, conventional approximate equation proposed by Japanese Unexamined Patent Publication, No. 3-87759 is shown below.

$$Mp=(m/dt)\times x,$$

where $$x=k\times c'/b',$$

$$b'=\rho\times(dt/\epsilon t+dp/\epsilon p), \text{ and}$$

$$c'=(-Vo+Vb+Vt).$$

Figure 5:
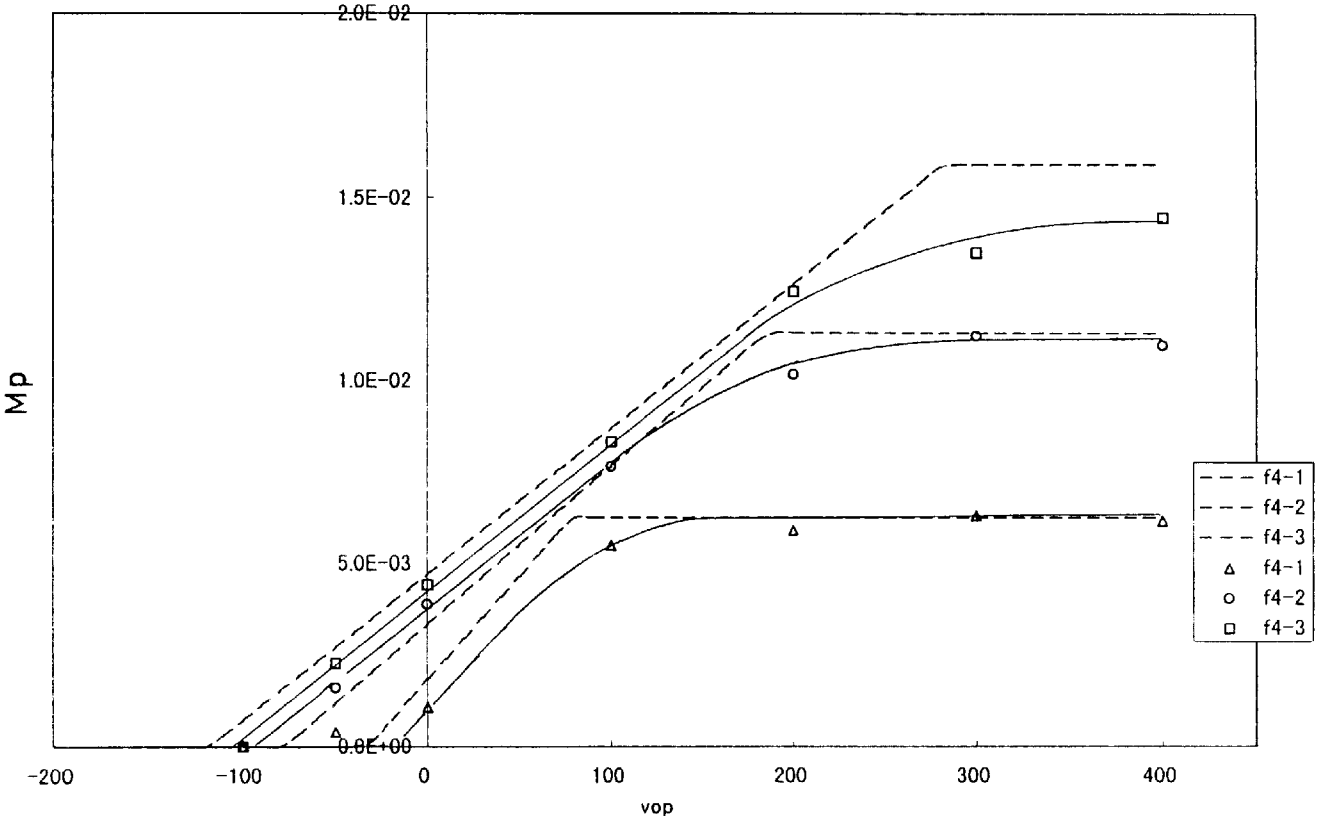
FIG. 5 is a graph indicating a development characteristic in the case where the development roller is a conductive roller.
Figure 6:
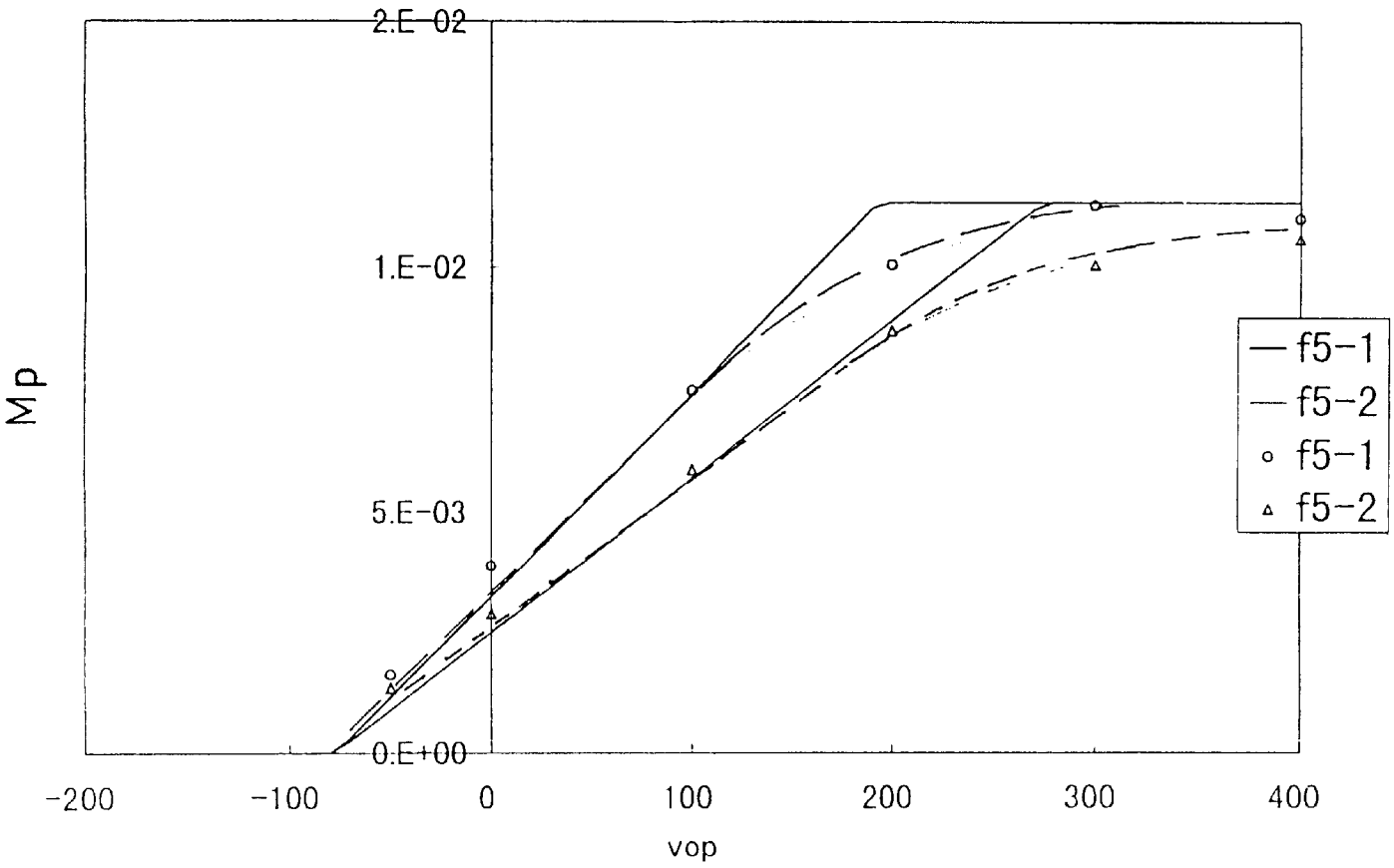
FIG. 6 is a graph indicating a development characteristic in the case where the development roller is a semiconducting roller.

An exemplary result of the development characteristics obtained by using equality (2) is shown in FIGS. 5 and 6. FIG. 5 is a graph in the case where the development roller is a conductive roller. In FIG. 5, the abscissa is Vop=Vo−Vp (V), the ordinate is Mp (kg/m$^2$), the blank triangles, circles, and squares indicative of the solid and dotted lines are measured values, respectively, and references f4-1, f4-2, and f4-3 indicate the cases of k=1.3, 2.36, and 3.32, respectively. In FIG. 6, the abscissa is Vop=Vo−Vp, the ordinate is Mp, the blank circles and triangles measured values, the plotted curves indicative of solid and dotted lines are measured values, respectively, and references f5-1 and f5-2 indicate the cases of K=2.36 (fix), the resistance values of the development roller 30 are $1.1\times10^5$ (Ωm$^2$) and $1.3\times10^6$ (Ωm$^2$), respectively. As illustrated in FIGS. 5 and 6, the simulated results well match the measured values.

Figure 7:
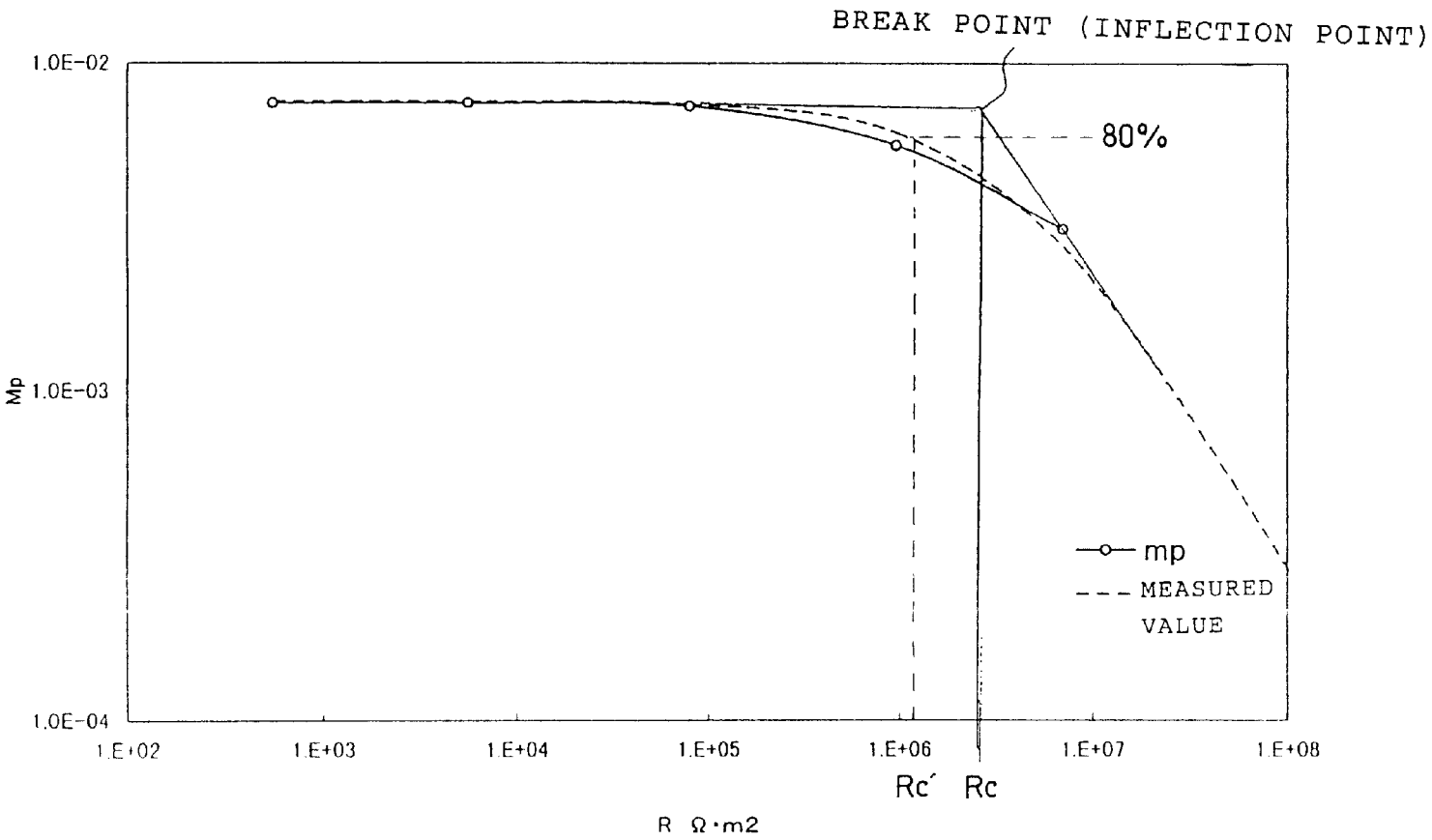
FIG. 7 is a graph indicating a relationship between the amounts of development and the resistance in a path of a development current.

A relationship between the developed amount Mp and the resistance Rr of the development roller 30 is shown in FIG. 7. In FIG. 7, Vo−Vp=100 (V), k=2.36, the blank circles indicate measured values, and the plotted curve indicates simulated result corresponding to the measured values. As illustrated in FIG. 7, the simulated result well matches the measured values. As understood from FIG. 7, high development efficiency can be attained at the point under the resistance value of break point corresponding to an inflection point of the developed amount Mp, and under the resistance value Rc' where the resistance value reaches a 80% of the maximum development amount Mp. Therefore, stable development can be performed, with employed the development characteristics within this region.

When the high-resistance layer 12 is laminated on the photoreceptor drum 10 as in the present invention, the resistance value Rr (Ωm$^2$) of the development roller 30 can be indicated by that of Rp (Ωm$^2$) of the photoreceptor drum 10. For example, letting the resistance of an intermediate layer to be Bp(Ωm$^2$), the minimum conditions for accomplishing stable development is shown below, independent of the resistance value Rr (Ωm$^2$) of the development roller 30.

$$Rp/(dt/\epsilon t+dp/\epsilon p)\leqq 1 \quad (3)$$

The inequality (3) corresponds to the condition that the resistance value Rr does not exceed the resistance value Rc in FIG. 7.

$$Rp/(dt/\epsilon t+dp/\epsilon p)\leqq 0.25 \quad (4)$$

Similarly, the resistance Rf (Ωm$^2$) of the development roller 30 at least should be met the following inequality.

$$(Rr/k)/(dt/\epsilon t+dp/\epsilon p)\leqq 1 \quad (5)$$

The inequality (5) corresponds to the condition that the resistance value Rr does not exceed the resistance value Rc in FIG. 7.

$$(Rr/k)/(dt/\epsilon t+dp/\epsilon p)\leqq 0.25 \quad (6)$$

The inequality (6) corresponds to the condition that the resistance value Rr does not exceed the resistance value Rc' in FIG. 7.

In the case where a series resistor element or equivalent current limit means is provided in the path of the development current, resistance value of the series resistor element, or that of the equivalent current limit means is let to be Rs(Ω), the simulation value Rs(Ω) should at least be met the following inequality.

$$(Rs\times vp\times W)/(dt/\epsilon t+dp/\epsilon p)\leqq 1 \quad (7)$$

The inequality (7) corresponds to the condition that the resistance value Rr does not exceed the resistance value Rc in FIG. 7.

$$(Rs\times vp\times W)/(dt/\epsilon t+dp/\epsilon p)\leqq 0.25 \quad (8)$$

The inequality (8) corresponds to the condition that the resistance value Rr does not exceed the resistance value Rc' in FIG. 7.

When all of the resistance value Rp (Ωm$^2$) of the photoreceptor drum 10, the resistance value Rr (Ωm$^2$) of the development roller 30, and the resistance value Rs (Ω) of the series resistor element or equivalent current limit means are considered, the minimum conditions can be expressed by the following inequalities (9) and (10).

$$(Rp+Rr/k+Rs\times vp\times W)/(dt/\epsilon t+dp/\epsilon p)\leqq 1 \quad (9)$$

The inequality (9) corresponds to the condition that the resistance value Rr does not exceed the resistance value Rc in FIG. 7.

$$(Rp+Rr/k+Rs\times vp\times W)/(dt/\epsilon t+dp/\epsilon p)\leqq 0.25 \quad (10)$$

The inequality (10) corresponds to the condition that the resistance value Rr does not exceed the resistance value Rc' in FIG. 7.

As explained above, according to the present invention, distribution of the surface potential on the photoreceptor layer due to charging can be stabilized. In addition, it eliminates the need for providing an additional charge injection layer, thus simplifying their construction.

All of the contents of the Japanese patent application, No. 11-206050 are incorporated into this specification by reference.

What is claimed is:

1. An image forming apparatus comprising:

a photoreceptor drum which rotates when the photoreceptor drum is driven, and said drum has a resistance layer which is provided on a photoreceptor support, and a photoreceptor layer, which is provided on said resistance layer, on which an electrostatic latent image is formed by exposure; and a charging roller which is arranged in contact with the photoreceptor drum so as to charge its surface;

wherein a condition, $T/(Rp\times\epsilon p/dp)>2.3$, is satisfied, where Rp (Ωm$^2$) is resistance per unit area of the resistance layer in the perpendicular direction, T (sec) is a passage time of a charging nip at each point on a surface of the photoreceptor drum, εp (F/m) is dielectric constant of the photoreceptor layer, and dp (m) is a film thickness of the photoreceptor layer.

2. The image forming apparatus according to claim 1, wherein said photoreceptor support is made of conductive resin, and is used as said resistance layer.

3. An image forming apparatus comprising:

a photoreceptor drum which rotates when the photoreceptor drum is driven, and said drum has a resistance layer which is provided on a photoreceptor support, and a photoreceptor layer, which is provided on said resistance layer, on which an electrostatic latent image is formed by exposure; and a development roller which is arranged in contact with the photoreceptor drum so as to supply a toner to its surface;

wherein a condition, $Rp/(dt/\epsilon t+dp/\epsilon p)\leqq 1$, is satisfied, where Rp ($\Omega m^2$) is resistance per unit area of the resistance layer in the perpendicular direction, dt (m) is a thickness of a toner layer before development, $\epsilon t$ (F/m) is a dielectric constant of the toner layer, dp (m) is a film thickness of the photoreceptor layer, and $\epsilon p$ (F/m) is a dielectric constant of the photoreceptor layer.

4. The image forming apparatus according to claim 3, wherein a condition, $Rp/(dt/\epsilon t+dp/\epsilon p)\leqq 0.25$, is satisfied.

5. The image forming apparatus according to claim 3, wherein said photoreceptor support is made of conductive resin.

6. An image forming apparatus comprising:

a photoreceptor drum which rotates when the photoreceptor drum is driven, and said drum has a resistance layer which is provided on a photoreceptor support, and a photoreceptor layer, which is provided on said resistance layer, on which an electrostatic latent image is formed by exposure;

a development roller which is arranged in contact with the photoreceptor drum so as to supply a toner to its surface; and wherein a condition, $(Rr/k)/(dt/\epsilon t+dp/\epsilon p)\leqq 1$, is satisfied, where Rr ($\Omega m^2$) is resistance per unit area of the development roller in the perpendicular direction, vr is a peripheral velocity of the development roller, vp is a peripheral velocity of the photoreceptor drum, k=vr/vp, dt (m) is a thickness of the toner layer before development, $\epsilon t$ (F/m) is a dielectric constant of the toner layer, dp (m) is a film thickness of the photoreceptor layer, and $\epsilon p$ (F/m) is a dielectric constant of the photoreceptor layer.

7. The image forming apparatus according to claim 6, wherein a condition, $(Rr/k)/(dt/\epsilon t+dp/\epsilon p)\leqq 0.25$, is satisfied.

8. An image forming apparatus comprising:

a photoreceptor drum which rotates when the photoreceptor drum is driven, and said drum has a resistance layer which is provided on a photoreceptor support, and a photoreceptor layer, which is provided on said resistance layer, on which an electrostatic latent image is formed by exposure;

a development roller which is arranged in contact with the photoreceptor drum so as to form a path of a development current, and to supply a toner to its surface;

wherein a condition, $(Rs\times vp\times W)/(dt/\epsilon t+dp/\epsilon p)\leqq 1$, is satisfied, where Rs ($\Omega$) is resistance of a current limit device, vp is a peripheral velocity of the photoreceptor drum, W (m) is an effective development width, dt (m) is a thickness of a toner layer before development, $\epsilon t$ (F/m) is a dielectric constant of the toner layer, dp (m) is a film thickness of the photoreceptor layer, and $\epsilon p$ (F/m) is a dielectric constant of the photoreceptor layer.

9. The image forming apparatus according to claim 8, wherein a condition, $(Rs\times vp\times W)/(dt/\epsilon t+dp/\epsilon p)\leqq 0.25$, is satisfied.

10. An image forming apparatus comprising:

a photoreceptor drum which rotates when the photoreceptor drum is driven, and said drum has a resistance layer which is provided on a photoreceptor support, and a photoreceptor layer, which is provided on said resistance layer, on which an electrostatic latent image is formed by exposure;

a development roller which is arranged in contact with the photoreceptor drum so as to form a path of a development current, and to supply a toner to its surface;

wherein a condition, $(Rp+Rr/k+Rs\times vp\times W)/(dt/\epsilon t+dp/\epsilon p)\leqq 1$, is satisfied, where Rp ($\Omega m^2$) is resistance per unit area of the resistance layer in the perpendicular direction, Rr ($\Omega m^2$) is resistance per unit area of the development roller in the perpendicular direction, vr is a peripheral velocity of the development roller, vp is a peripheral velocity of the photoreceptor drum, k=vr/vp, Rs ($\Omega$) is resistance of a current limit device, W (m) is an effective development width, dt (m) is a thickness of the toner layer before development, $\epsilon t$ (F/m) is a dielectric constant of a toner layer, dp (m) is a film thickness of the photoreceptor layer, and $\epsilon p$ (F/m) is a dielectric constant of the photoreceptor layer.

11. The image forming apparatus according to claim 10, wherein a condition, $(Rp+Rr/k+Rs\times vp\times W)/(dt/\epsilon t+dp/\epsilon p)\leqq 0.25$, is satisfied.

12. An image forming apparatus comprising:

a photoreceptor drum which rotates when the photoreceptor drum is driven, said drum including a resistance layer and a photoreceptor layer, the layers being arranged on a photoreceptor support, wherein an electrostatic latent image can be formed on the photoreceptor layer by exposure; and a charging roller, contactable with the photoreceptor drum so as to charge its surface, wherein a condition, $T/(Rp\times\epsilon p/dp)>2.3$, is satisfied, where Rp ($\Omega m^2$) is resistance per unit area of the resistance layer in a perpendicular direction, T (sec) is a passage time of a charging nip at each point on a surface of the photoreceptor drum, $\epsilon p$ (F/m) is dielectric constant of the photoreceptor layer, and dp (m) is a film thickness of the photoreceptor layer.

13. The image forming apparatus according to claim 12, wherein said photoreceptor support is made of conductive resin, and is used as said resistance layer.

14. An image forming apparatus comprising:

a photoreceptor drum which rotates when the photoreceptor drum is driven, said drum including a resistance layer and a photoreceptor layer, the layers being arranged on a photoreceptor support wherein an electrostatic latent image can be formed on the photoreceptor layer by exposure; and a development roller, contactable with the photoreceptor drum so as to supply a toner to its surface, wherein a condition, $Rp/(dt/\epsilon t+dp/\epsilon p)\leqq 1$, is satisfied, where Rp ($\Omega m^2$) is resistance per unit area of the resistance layer in a perpendicular direction, dt (m) is a thickness of a toner layer before development, $\epsilon t$ (F/m) is a dielectric constant of the photoreceptor layer, and $\epsilon p$ (F/m) is a dielectric constant of the photoreceptor layer.

15. The image forming apparatus according to claim 14, wherein a condition, $Rp/(dt/\epsilon t+dp/\epsilon p)\leqq 0.25$, is satisfied.

16. The image forming apparatus according to claim 14, wherein said photoreceptor support is made of conductive resin.

17. An image forming apparatus comprising:

a photoreceptor drum which rotates when the photoreceptor drum is driven, said drum including a resistance layer and a photoreceptor layer, the layers being arranged on a photoreceptor support, wherein an electrostatic latent image can be formed on the photoreceptor layer by exposure; and a development roller, contactable with the photoreceptor drum so as to supply a toner to its surface, wherein a condition, $(Rr/k)/(dt/\epsilon t+dp/\epsilon p)\leqq 1$, is satisfied, where Rr ($\Omega m^2$) is resistance per unit area of the development roller in perpendicular direction, vr is a peripheral velocity of the development roller, vp is a peripheral velocity of the photoreceptor drum, k=vr/vp, dt (m) is a thickness of the toner layer before development, $\epsilon t$ (F/m) is a dielectric constant of the toner layer, dp (m) is a film thickness of the photoreceptor layer, and $\epsilon p$ (F/m) is a dielectric constant of the photoreceptor layer.

18. The image forming apparatus according to claim 17, wherein a condition $(Rr/k)/(dt/\epsilon t+dp/\epsilon p)\leqq 0.25$, is satisfied.

19. An image forming apparatus comprising:

a photoreceptor drum which rotates when the photoreceptor drum is driven, said drum including a resistance layer and a photoreceptor layer, the layers being arranged on a photoreceptor support, wherein an electrostatic latent image can be formed on the photoreceptor layer by exposure; and a development roller, contactable with the photoreceptor drum so as to form a path of a development current, and to supply a toner to its surface, wherein a condition, $(Rs\times vp\times W)/(dt/\epsilon t+dp/\epsilon p)\leqq 1$, is satisfied, where Rs ($\Omega$) is resistance a current limit device, vp is a peripheral velocity of the photoreceptor drum, W (m) is an effective development width, dt (m) is a thickness of a toner layer before development, $\epsilon t$ (F/m) is a dielectric constant of the toner layer, dp (m) is a film thickness of the photoreceptor layer, and $\epsilon p$ (F/m) is a dielectric constant of the photoreceptor layer.

20. The image forming apparatus according to claim 19, wherein a condition, $(Rs\times vp\times W)/(dt/\epsilon t+dp/\epsilon p)\leqq 0.25$, is satisfied.

21. An image forming apparatus comprising:

a photoreceptor drum which rotates when the photoreceptor drum is driven, said drum including a resistance layer and a photoreceptor layer, the layers being arranged on a photoreceptor support, wherein an electrostatic latent image can be formed on the photoreceptor layer by exposure; and a development roller, contactable with the photoreceptor drum so as to form a path of a development current, and to supply a toner to its surface, wherein a condition, $(Rp+Rr/k+Rs\times vp\times W)/(dt/\epsilon t+dp/\epsilon p)\leqq 1$, is satisfied, where Rp ($\Omega m^2$) is resistance per unit area of the resistance layer in a perpendicular direction, Rr ($\Omega m^2$) is resistance per unit area of the development roller in the perpendicular direction, vr is a peripheral velocity of the development roller, vp is a peripheral velocity of the photoreceptor drum, k=vr/vp, Rs ($\Omega$) is resistance of a current limit device, W (m) is an effective development width, dt (m) is a thickness of the toner layer before development, $\epsilon t$ (F/m) is a dielectric constant of a toner layer, dp (m) is a film thickness of the photoreceptor layer, and $\epsilon p$ (F/m) is a dielectric constant of the photoreceptor layer.

22. The image forming apparatus according to claim 21, wherein a condition, $(Rp+Rr/k+Rs\times vp\times W)/(dt/\epsilon t+dp/\epsilon p)\leqq 0.25$, is satisfied.

* * * * *